United States Patent [19]

Houman

[11] Patent Number: 4,458,735

[45] Date of Patent: Jul. 10, 1984

[54] DISPENSING ARRANGEMENT FOR A BEVERAGE SUCH AS A MILKSHAKE

[75] Inventor: Leif Houman, Oyster Bay, N.Y.

[73] Assignee: Medetec Industries, Inc.

[21] Appl. No.: 431,614

[22] Filed: Sep. 30, 1982

[51] Int. Cl.[3] ..... B65B 1/30

[52] U.S. Cl. ..... 141/95; 141/198; 250/577

[58] Field of Search ..... 141/94–96, 141/192, 198, 206, 207, 351, 360, 217, 227; 250/223 B, 223 R, 577; 73/293; 222/129.1, 129.2

[56] References Cited

U.S. PATENT DOCUMENTS

| | | | |
|---|---|---|---|
| 3,454,759 | 7/1969 | Calhoun | 250/577 |
| 3,702,625 | 11/1972 | Schmidt | 250/577 |
| 4,066,363 | 1/1978 | Juvinall | 250/223 B |
| 4,182,451 | 1/1980 | Watson | 250/223 B |
| 4,236,553 | 12/1980 | Reichenberger | 141/198 |
| 4,261,397 | 4/1981 | Guy | 141/95 |

FOREIGN PATENT DOCUMENTS

| | | | |
|---|---|---|---|
| 2437798 | 2/1976 | Fed. Rep. of Germany | 73/293 |

*Primary Examiner*—Stephen Marcus
*Assistant Examiner*—Kenneth S. Putnam
*Attorney, Agent, or Firm*—Scully, Scott, Murphy & Presser

[57] ABSTRACT

An arrangement for automatically controlling the dispensing of a beverage such as a frothy milk shake into an open mouth container such as a translucent paper or styrofoam cup. A dispensing station defines a designated position for the cup to be filled, and a dispensing nozzle is positioned above that designated position. A radiation source is positioned above the cup to direct radiation downwardly through the open mouth thereof such that it passes through the side walls of the cup. A radiation detector is positioned adjacent to an exterior wall of the cup at a vertical position thereon at which the cup holds a "full" dispensed quantity of beverage, such that it produces an output signal indicative of the radiation passing through the wall at the full position. The output signal is compared with a given threshold level, and when it falls therebelow, thereby indicating that the dispensed beverage is at the "full" height, the dispensing operation is terminated.

16 Claims, 4 Drawing Figures

DISPENSING ARRANGEMENT FOR A BEVERAGE SUCH AS A MILKSHAKE

BACKGROUND OF THE INVENTION

1. Field of the Invention

The present invention relates generally to a dispensing arrangement for fast food beverages such as milkshakes and similar drinks having a tendency to froth, and more particularly pertains to a dispenser of the aforementioned kind which delivers a precisely quantified portion of such beverages on a controlled and repetitive basis.

2. Discussion of the Prior Art

Many types of arrangements are known in the prior art for dispensing fast food beverages such as milkshakes and similar drinks. The dispensing arrangements normally have a dispensing nozzle and a valve associated therewith for controlling the dispensing operation. Manually controlled dispensing arrangements, wherein an operator manually controls the dispensing vavle, have some serious disadvantages associated therewith. The operator should maintain the dispensing valve open for a sufficient time period to provide or serve the correct quantity of beverage in each cup. The delivery of too little a quantity of a beverage such as a milkshake results in the customer not receiving the amount he paid for, and often results in customer dissatisfaction. On the other hand, the venting of too large a quantity of beverage results in the retail fast food establishment loosing a certain amount of profit on that sale.

One approach employed by the prior art to solve this problem is to mark or emboss a line on the cup at a "full" position. This approach requires the close attention of the dispensing attendant during the dispensing operation, and most often results in the operator overfilling the cup, either because of his slow reaction time or simply because of a lack of attention to duty. The relatively high volume of such dispensing operations in a typical fast food retail outlet translates into a considerable loss of profit for the establishment. Moreover, the detection of the beverage in relationship to the full line is often very difficult to perceive because of the large amount of froth which typically obscures the line prior to the level of the liquid milkshake actually reaching it.

A further disadvantage of this prior art approach is that the dispensing attendant is required to devote his full attention to the dispensing operation, and thus is not free to accomplish other chores, such as the filling of other portions of a customer's order.

It would be extremely desirable to have a dispensing arrangement which automatically provides an accurately dispensed quantity of a beverage such as a milkshake. The prior art is replete with many arrangements for detecting the dispensing of a given quantity of a liquid into a bottle by directing a light beam across the neck of the bottle at a full position location and detecting the interruption of the light beam by the rising liquid in the bottle. A simple approach of this nature has some serious drawbacks and disadvantages when a frothy type of liquid is being dispensed, as the froth on top of the liquid tends to obscure the light beam prior to the liquid level reaching a full position, and thus often results in erroneous and inaccurate quantities of liquid being dispensed. This can be a relatively severe problem as the profits from this type of retail business are often related directly to the dispensing of an accurate quantity or portion on a repetitive baiss.

Calhoun U.S. Pat. No. 3,454,759 is of interest to the present invention by disclosing a system for detecting the level of a liquid in a container even when froth or foam is present thereabove. The system directs a light beam with frequencies in both the visible and infrared bands towards the container at substantially the level to be measured. The container passes the light in the visible and infrared bands. The liquid in the container passes the light in the visible band but attenuates the light in the infrared band, while the foam thereabove attenuates the light in both the visible and infrared bands. The light passing from the container is filtered such that only light in the infrared band is passed to an infrared cell. When the infrared cell continuously produced a signal of relatively low amplitude, an indication is provided that neither the liquid or the foam above the liquid has reached the desired level. A second detector cell receives the visible light passing from the container. When this cell produces a signal of relatively high amplitude, an indication is provided that the foam above the liquid is not yet at the desired level. In this way, circuitry associated with the infrared and second detector cells provides an indication as to the level of the liquid in the container which is not rendered inaccurate by the foam thereabove. This prior art arrangement is relatively complicated when compared with the simple and straightforward approach of the present invention.

Upton U.S. Pat. No. 4,202,387 is also of interest to the subject invention by providing a beverage dispensing control system in which a signal is generated which indicates the size of the container to be filled. Valve control timer means, responsive to this selection signal, opens a dispensing valve for the correct duration of time required to fill a container of the indicated size. The container size is sensed by a set of photosensors and associated light sources that are mounted on the dispenser housing beneath the spout. Each light source/photosensor assembly is located at a position appropriate to sense a container of a given size. When the container is placed on the base of the dispenser housing, light is reflected from one or more of the light source back into the associated photosensors. Discrimination circuitry associated with the photosensors then establishes the size of the container, depending on which of the photosensors detects the reflected light. This patent utilizes reflected light to detect different size containers, and does not utilize light transmitted through the top and one side of a container to provide an accurate measurement of the dispensed liquid despite froth or foam on top thereof.

SUMMARY OF THE INVENTION

Accordingly, it is a primary object of the present invention to provide a dispensing arrangement for dispensing accurately controlled portions of a frothy type of beverage such as a milkshake or other similar drink.

A further object of the subject invention is the provision of a dispensing arrangement of the aforementioned type which dispenses a given quantity of a frothy beverage despite substantial amounts of foam or froth on top thereof. Moreover, another important object of the present invention is to provide a dispensing arrangement as described which can be retrofitted to existing dispensing machines without a substantial amount of modification thereto.

In accordance with the teachings heren, the present invention provides an arrangement for automatically controlling the dispensing of a beverage such as a frothy milkshake into an open mount container such as a translucent paper or styrofoam cup. In this arrangement, a dispensing station defines a designated position for the cup to be filled, and a dispensing nozzle is positioned above that designated position. A radiation source is positioned above the cup to direct radiation downwardly through the open mouth thereof such that it passes through the side walls of the cup. A radiation detector is positioned adjacent to an exterior wall of the cup at a vertical position thereon at which the cup holds a "full" dispensed quantity of beverage, such that is produces an output signal indicative of the radiation passing through the wall at the full position. The output signal is compared with a given threshold level, and when it falls therebelow, thereby indicating that the dispensed beverage is at the "full" height, the dispensing operation is terminated.

Operation of the subject invention can be optimized by utilizing a directional radiation source, such as a directional lamp having a focusing lens constructed as an integral part thereof. However, other embodiments could use a nondirectional radiation source properly positioned relative to the dispensing nozzle such that the dispensed beverage does not interfere with a direct path of radiation from the source to the detector. In fact, it appears that ambient radiation could also be utilized, however the dependability of the operation of an embodiment of this nature would probably be subject to too many uncontrolled factors.

In the practice of the present invention, the detected radiation or light beam passing directly from the source to the detector is incident upon the surface of the beverage near or at the full position at a relatively large oblique angle relative thereto, such as an angle in the range of 30° to almost 90°. In the absence of beverage or froth, the radiation detector which is adjacent the exterior wall of the container detects diffused radiation passing through the side wall. As the level of beverage rises in the container, the froth eventually begins to attenuate the detected radiation.

However, because of the aforesaid large oblique angle, the detected radiation easily penetrates and passes through the small quantity of froth in its path. Only the presence of the liquid itself directly in the path of the detected radiation results in substantially complete attenuation thereof, such that the cut-off characteristic of the electrical output signal of the radiation detector is quite sharp.

In greater particularity, in one embodiment the radiation detector circuit includes a comparator for comparing the amplitude of the detector output signal with the amplitude of a threshold signal which is adjustable such that the cut-off characteristics of the dispensing arrangement are both accurate and sharply defined. The dispensing arrangement can also include a sensor for sensing the presence of a cup properly positioned in the dispensing station, and is responsive thereto to initiate the dispensing operation. In one disclosed embodiment, this sensor includes a second comparator for comparing the amplitude of the detector output signal with the amplitude of a second threshold signal which is substantially greater than the first threshold signal. When a cup is placed in the dispensing station such that it partially attenuates the detected radiation, the second comparator produces an output indicative of the cup's presence when the amplitude of the detector output signal falls below the amplitude of the second threshold signal.

In one disclosed embodiment, the dispensing arrangement includes a plurality of dispensing stations for different size cups which are positioned adjacent to each other. Each dispensing station has associated therewith a separate radiation beam, a separate radiation detector and separate control circuitry.

BRIEF DESCRIPTION OF THE DRAWINGS

The foregoing objects and advantages of the present invention for a frothy beverage dispensing arrangement may be more readily understood by one skilled in the art with reference being had to the following detailed description of several preferred embodiments thereof, taken in conjunction with the accompanying drawings wherein like elements are designated by identical reference numerals through the several views, and in which.

DETAILED DESCRIPTION OF THE DRAWINGS

Figure 1:
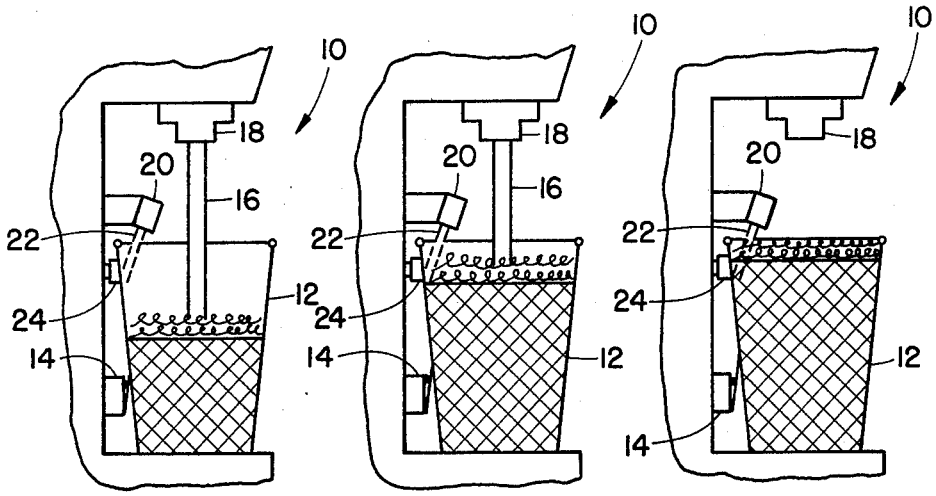
FIG. 1 illustrates the sequence of operations of a first exemplary embodiment of a milkshake dispensing arrangement pursuant to the present invention.

Referring to the drawings in detail, FIG. 1 illustrates a sequence of operations of an automatic beverage dispensing arrangement pursuant to the teachings of the present invention. In the arrangement illustrated in three sequences, progressing from left to right, a dispensing station 10 defines a designated position for a cup 12 to be filled with a beverage such as a frothy milk shake or a similar drink. The cup is ascertained to be in its designated correct position by a microswitch 14 which, in a completely automatic embodiment, can initiate the dispensing of a flow of milk shake 16 through a dispensing nozzle 18 positioned centrally above the cup 12. A milk shake machine typically includes a freezer unit and a dispensing mechanism including a valve associated with the nozzle 18. In preferred embodiments of the present invention, the valve is an electrically or pneumatically, or otherwise remotely, operated valve controlled as described hereinbelow.

The cup is positioned below a light or radiation source 20 which directs a light beam 22 downwardly through the open top mouth of the cup 12 such that it then passes through the side walls of the cup. A radiation detector 24 is positioned adjacent to an exterior wall of the cup at a vertical position thereon at which the cup holds a desired or "full" dispensed quantity of beverage, such that it produces an output signal indicative of radiation passing through the wall at the full position. The output signal from detector 24 is then compared with a given threshold level, and when it falls therebelow, thereby indicating that the dispensed beverage is at the "full" height, the dispensing operation is terminated.

The radiation source 20 could be nondirectional or directional in nature. In the latter instance it might be a directional lamp having a focusing lens constructed as an integral part thereof, or an LED with an associated directive optical system, or a small, nonpowerful laser. The radiation souce 20 could be positioned relatively close to the detector 24 as shown in the embodiment of FIG. 1, or could project a greater distance from the side of the dispensing machine, with the only limitation being that the flow of beverage 16 should not be in a direct radiation path between the two.

In the practice of the present invention, the detected radiation 22 passing directly from the source to the detector is incident upon the surface of the beverage, near or at the full position, at a relatively large oblique angle relative thereto, such as an angle in the range of 30° to almost 90°. In the absence of beverage or froth, the radiation detector which is adjacent the exterior wall of the container detects diffused radiation passing through the side wall. As the level of beverage rises in the container, the froth eventually begins to attenuate the detected radiation. However, because of the aforesaid large oblique angle, the detected radiation easily penetrates and passes through the small quantity of froth in its path. Only the presence of the liquid itself directly in the path of the detected radiation results in substantially complete attenuation thereof, such that the cut-off characteristic of the electrical output signal of the radiation detector is quite sharp. This would not be the case if the light beam were directed nearly horizontally across the "full" height of the container, as in the prior art, as the relatively large quantity of froth introduced into the path of the beam would result in substantial attenuation thereof prior to the level of liquid reaching the path of the beam.

When a cup 12 is not positioned in the designated position, the photodetector 24 produces a relatively high amplitude DC electrical output signal. When a translucent paper cup, which is typically used in fast food establishments, is placed in the designated position of the vending station, the light beam 22 is slightly attenuated thereby, such that the photodetector 24 produces a slightly lower amplitude DC electrical output signal. As the cup becomes filled and foam or froth rises into the path of the beam 22, as illustrated in the middle sequence of FIG. 1, the froth begins to attenuate the beam slightly. However, the relatively large oblique angle of the beam relative to the liquid surface provides an arrangement in which only the presence of the liquid itself in the radiation beam, as illustrated in the right sequence of FIG. 1, results in substantially complete attenuation thereof, thereby providing a rather sharp cut-off characteristic for the electrical output signal of the detector 24.

Figure 2:
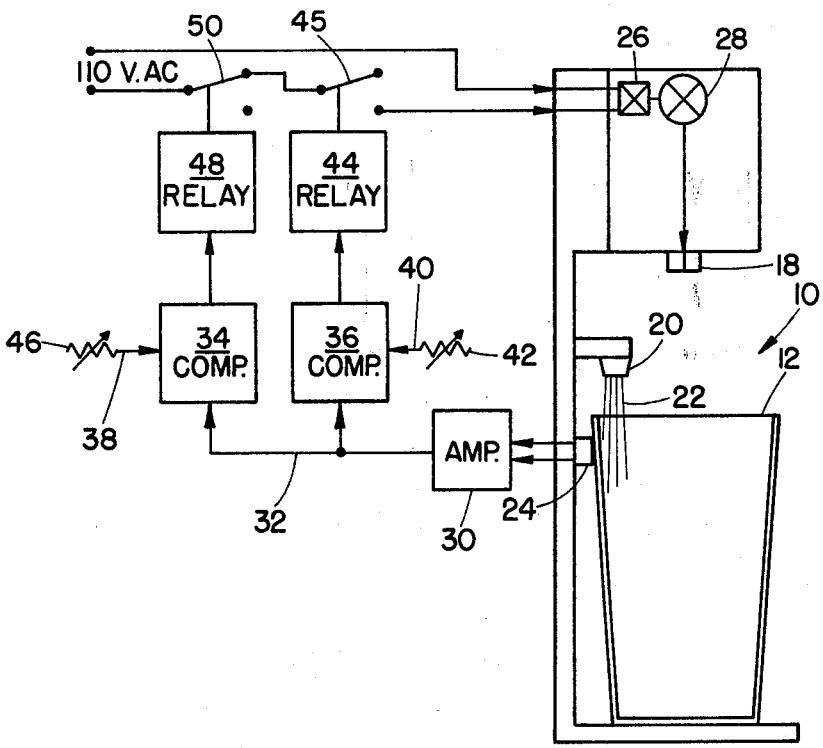
FIG. 2 illustrates exemplary control circuitry for a second embodiment of a dispensing arrangement in accordance with the teachings of the subject invention.

The aforementioned slight attenuation of the radiation beam by the presence of only the translucent cup 12 can be utilized to advantage to sense that the cup is properly in position and to initiate the vending operation. An advantageous embodiment of this nature is illustrated in FIG. 2, which eliminates the requirement for a separate microswitch 14. In this embodiment 110–120 Volts AC from a typical electrical outlet is utilized to actuate a solenoid 26 which controls and opens a vending valve 28 to control vending of the beverage.

The control circuit illustrated in FIG. 2 includes an amplifier 30 for amplifying the output signal of photodetector 24 which is then directed on line 32 to first and second comparator circuits 34 and 36 which compare the magnitude of the detector signal with first and second reference threshold signals respectively on lines 38 and 40. The second reference signal on line 40, adjustable by variable resistor 42, represents a level below which the detector signal on line 32 will fall when the cup 12 is placed in the dispensing station 10. Accordingly, when the amplitude of the detector signal on line 32 is detected by comparator 36 to fall below the amplitude of the second reference signal on line 40, the comparator 36 actuates a relay 44 to close a switch 45 to supply power to solenoid 26, thereby initiating the dispensing operation.

The first reference signal on line 38, adjustable by variable resistor 46, represents a level below which the detector signal on line 32 will fall when the rising beverage substantially completely attenuates radiation in path 22, thereby indicating that the beverage has reached a "full" position in the container. Accordingly, when the amplitude of the detector signal on line 32 is detected by comparator 34 to fall below the amplitude of the first reference signal on line 38, the comparator 34 actuates a relay 48 to open a switch 50 to cut off power to solenoid 26, thereby terminating the dispensing operation when the cup is full.

Figure 3:
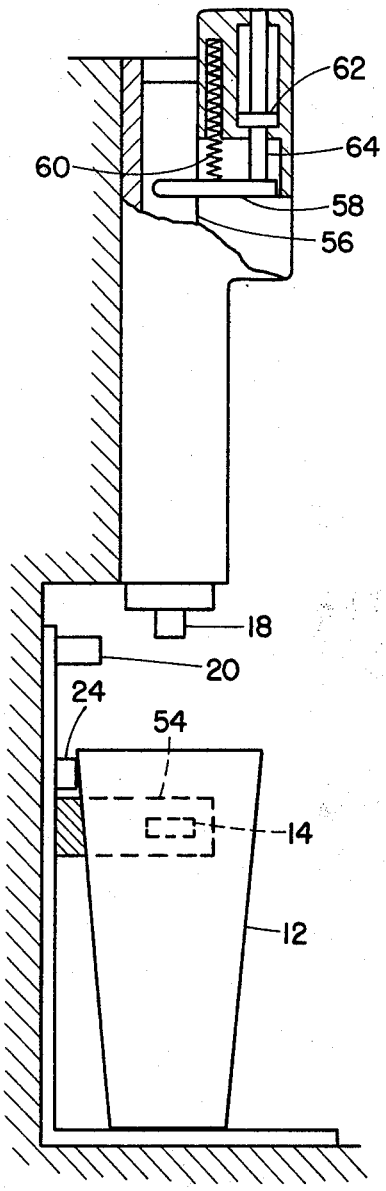
FIG. 3 illustrates a partially sectional, elevational view of a beverage dispenser arrangement constructed pursuant to the present invention which is retrofitted onto a typical prior art dispensing machine.

FIG. 3 illustrates a partially sectional, elevational view of a milk shake dispensing arrangement of the prior art which is retrofitted with a dispensing control system as taught by the present invention. The cup 12 is correctly positioned by an appropriately shaped curved cradle 54 in the dispensing station, and a microswitch 14 associated with the cradle senses the cup's presence. The dispensing valve includes a vertically movable cylindrical shaft 56, having a cantilevered handle 58 projecting therefrom, with a spring 60 biasing the valve shaft toward a closed position of the valve. A pneumatically controlled piston 62 having an actuating shaft 64 controls the position of the dispensing valve, and is in turn controlled by an arrangement similar to that illustrated in FIG. 1 or 2.

Figure 4:
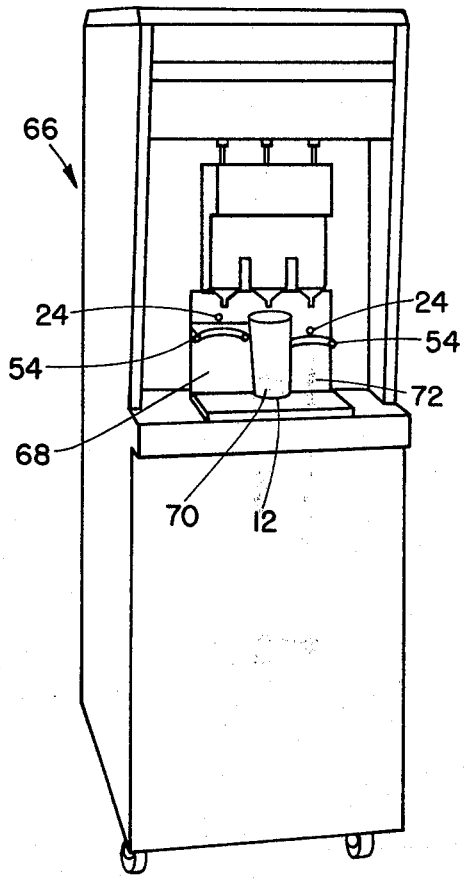
FIG. 4 is a perspective view of an embodiment of a beverage vending machine having a plurality of dispensing stations for different size cups, with each station including an individual beverage level detecting arrangement.

FIG. 4 is a perspective view of a milk shake vending machine 66 having three separate dispensing stations 68, 70 and 72, respectively for large, medium and small size milk shakes, with the medium dispensing station having a medium size container 12 illustrated therein. Each station has a separate container cradle 54 associated therewith, with the height and size of each cradle being appropriate for its size container. Each dispensing station has individually associated therewith a separate radiation source, a separate detector 24, each at an appropriate height, and separate control circuitry. Moreover, each control circuit preferably has an individual counter associated therewith, such that an accounting is maintained of the number of each size milk shake which is dispensed.

While several embodiments and variations of the present invention for a milk shake dispensing arrangement are described in detail herein, it should be apparent that the disclosure and teachings of the present invention will suggest many alternative designs to those skilled in the art.

What is claimed is:

1. An arrangement for automatically controlling the dispensing of a beverage into an open mouth translucent container such as a cup, comprising:

a. a dispensing station defining a designated position for a cup to be filled, and a dispensing nozzle placed above the designated position for dispensing a beverage into a cup positioned therebeneath;

b. a radiation source, positioned above a translucent cup placed in said designation position, for directing radiation downwardly through the open mouth of the cup;

c. a radiation detector, positioned adjacent to an exterior wall of a translucent cup in said designated position at a vertical position on the wall at which the cup holds a desired or full dispensed quantity of beverage, for detecting the diffused radiation passing through and diffused by the translucent cup wall at the full position and for producing an output signal indicative thereof;

d. means for detecting when said output signal falls below a given threshold level, which indicates the dispensed beverage has filled the cup to the full vertical position; and e. means, responsive to said detecting means, for terminating the dispensing of beverage through said dispensing nozzle.

2. An arrangement for automatically controlling the dispensing of a beverage as claimed in claim 1, for dispensing a frothy milk shake.

3. An arrangement for automatically controlling the dispensing of a milk shake as claimed in claim 2, said radiation source being positioned such that radiation passing directly from the source to the detector is incident upon the the surface of the milk shake, at or near the full position, at a relatively large oblique angle relative thereto, such that the relatively large oblique angle allows an accurate measurement of the milk shake level in the cup in spite of the presence of froth.

4. An arrangement for automatically controlling the dispensing of a milk shake as claimed in claim 3, wherein said relatively large oblique angle is in the range bewtween 30° and 90°.

5. An arrangement for automatically controlling the dispensing of a milk shake as claimed in claim 4, further including means for sensing the presence of a cup properly positioned in said dispensing station, and means, responsive to said sensing means, for initiating the dispensing of the milk shake through said dispensing nozzle.

6. An arrangement for automatically controlling the dispensing of a milk shake as claimed in claim 5, said detecting means including a first comparator for comparing the amplitude of said output signal with the amplitude of a first threshold signal, and means for adjusting the amplitude of said first threshold signal.

7. An arrangement for automatically controlling the dispensing of a milk shake as claimed in claim 6, said sensing means including a second comparator for comparing the amplitude of said output signal with the amplitude of a second threshold signal, having a larger amplitude than said first threshold signal, and producing a dispensing signal indicative of the presence of the cup when the amplitude of said output signal falls below the amplitude of the second threshold signal.

8. An arrangement for automatically controlling the dispensing of a milk shake as claimed in claim 7, including a plurality of said dispensing stations for different size cups positioned adjacent to each other, each dispensing station having associated therewith a radiation source, a radiation detector, a detecting means, and a terminating means, all as recited in claim 1.

9. An arrangement for automatically controlling the dispensing of a beverage into an open mouth container as claimed in claim 1, said radiation source being positioned such that radiation passing directly from the source to the detector is incident upon the surface of the beverage, at or near the full position, at a relatively large oblique angle relative thereto, such that the relatively large oblique angle allows an accurate measurement of the beverage level in the cup in spite of the presence of froth.

10. An arrangement for automatically controlling the dispensing of a beverage into an open mouth container as claimed in claim 9, wherein said relatively large oblique angle is in the range between 30° and 90°.

11. An arrangement for automatically controlling the dispensing of a beverage into an open mouth container as claimed in claim 1, further including means for sensing the presence of a cup properly positioned in said dispensing station, and means, responsive to said sensing means, for initiating the dispensing of the beverage through said dispensing nozzle.

12. An arrangement for automatically controlling the dispensing of a beverage into an open mouth container as claimed in claim 11, said detecting means including a first comparator for comparing the amplitude of said output signal with the amplitude of a first threshold signal, and means for adjusting the amplitude of said first threshold signal.

13. An arrangement for automatically controlling the dispensing of a beverage into an open mouth container as claimed in claim 12, said sensing means including a second comparator for comparing the amplitude of said output signal with the amplitude of a second threshold signal, having a larger amplitude than said first threshold signal, and producing a dispensing signal indicative of the presence of the cup when the amplitude of said output signal falls below the amplitude of the second threshold signal.

14. An arrangement for automatically controlling the dispensing of a beverage into an open mouth container as claimed in claim 13, including a plurality of said dispensing stations for different size cups positioned adjacent to each other, each dispensing station having associated therewith a radiation source, a radiation detector, a detecting means, and a terminating means.

15. An arrangement for automatically controlling the dispensing of a beverage into an open mouth container as claimed in claim 1, said detecting means including a first comparator for comparing the amplitude of said output signal with the amplitude of a first threshold signal, and means for adjusting the amplitude of said first threshold signal.

16. An arrangement for automatically controlling the dispensing of a beverage as claimed in claim 1, including a plurality of said dispensing stations for different size cups positioned adjacent to each other, each dispensing station having associated therewith a radiation source, a radiation detector, a detecting means, and a terminating means, all as recited in claim 1.

* * * * *